US006099913A

United States Patent [19]

Clarke et al.

[11] Patent Number: 6,099,913

[45] Date of Patent: Aug. 8, 2000

[54] METHOD FOR CURTAIN COATING AT HIGH SPEEDS

[75] Inventors: Andrew Clarke, Berkhamsted; Terence D. Blake, Tring, both of United Kingdom; Kenneth J. Ruschak, Rochester, N.Y.

[73] Assignee: Eastman Kodak Company, Rochester, N.Y.

[21] Appl. No.: 09/175,519

[22] Filed: Oct. 20, 1998

[51] Int. Cl.[7] ..... B05D 1/30

[52] U.S. Cl. ..... 427/420; 427/8; 118/DIG. 4

[58] Field of Search ..... 427/420, 8; 118/DIG. 4

[56] References Cited

U.S. PATENT DOCUMENTS

| | | | |
|---|---|---|---|
| 2,761,791 | 9/1956 | Russel . | |
| 3,508,947 | 4/1970 | Hughes . | |
| 3,632,374 | 1/1972 | Greiller . | |
| 5,264,339 | 11/1993 | Tavernier et al. | 427/420 |
| 5,391,401 | 2/1995 | Blake et al. | 427/420 |
| 5,393,571 | 2/1995 | Suga et al. . | |
| 5,609,923 | 3/1997 | Clarke | 427/420 |

FOREIGN PATENT DOCUMENTS

| | | |
|---|---|---|
| 0773472 A1 | 5/1997 | European Pat. Off. . |
| 7-119083 | 5/1995 | Japan . |
| WO 89/05477 | 6/1989 | WIPO . |
| WO/92/1157 | 7/1992 | WIPO . |
| WO/92/11572 | 7/1992 | WIPO . |

OTHER PUBLICATIONS

Electrets, "Physical Principles of Electrets", edited by G. M. Sessler, Second Enlarged Edition, pp. 13–19, (No Date).

Electromagnetic Fields and Waves; by Paul Lorrain and Dale Corson; "Electromagnetism" 2nd edition, (No Date).

British Standard 1134: Part 2: 1990, "Assessment of Surface Texture", entrusted by General Mechanical Engineering Standards Policy Committee (GME/–) to Technical Committee GME/10, pp. 1 through 17, (No Month Date).

British Standard, BS ISO 4287: 1997, "Geometric Product Specifications (GPS)—Surface Texture: Profile Method—Terms, definitions and surface texture parameters", entrusted to Technical Committee TDE/4, pp. 1 through 25, (No Month Date).

British Standard BS: Part 1, 1988, "Assessment of Surface Texture", prepared by General Mechanical Engineering Standards Committee, pp. 1 through 27, (No Month Date).

*The Mechanics of Thin Film Coatings,* by P.H. Gaskell, M.D. Savage, J.L. Summers; "Recirculating Flows in Curtain Coating" by A. Clarke, pp. 32–41, (No Date).

*Liquid Film Coating,* by Stephen F. Kistler and Peter M. Schweizer; 1st edition, Chapman & Hall, 1997, (No Month Date).

"Hydrodynamic Assist of Dynamic Wetting" by Terence D. Blake, Andrew Clarke, and Kenneth J. Ruschak, AlChE Journal, Feb. 1994, vol. 40, No. 2, pp. 229–242.

*Primary Examiner*—Katherine A. Bareford
*Attorney, Agent, or Firm*—Mark G. Bocchetti

[57] ABSTRACT

A method for curtain coating various compositions at high speed onto a continuously moving receiving surface comprises a) forming a composite layer of a plurality of coating compositions having density ρ of total volumetric flow rate per unit width Q, forming a freely falling curtain from said composite layer, and impinging said freely falling curtain of height h against a continuously moving receiving surface such that the point of impingement has an application angle θ, b) providing said receiving surface with roughness, $R_z$(DIN), between about 2 μm and about 20 μm, and c) providing said coating composition forming the layer adjacent to said receiving surface with a viscosity measured at a shear rate of 10,000 $s^{-1}$ sufficiently high that, when combined with said roughness $R_z$, said curtain height h, said application angle θ, said total volumetric flow rate per unit width Q, and said minimum liquid density ρ, gives a value of specifying parameter $\phi_0$ that is greater than 1, and point whereby high coating speeds can be attained.

6 Claims, 7 Drawing Sheets

METHOD FOR CURTAIN COATING AT HIGH SPEEDS

FIELD OF THE INVENTION

The present invention relates to a method by which a plurality of viscous coating compositions may be curtain coated as a composite layer at high speed onto a continuously moving receiving surface, as in the manufacture of photographic films, photographic papers, magnetic recording tapes, adhesive tapes, etc.

BACKGROUND OF THE INVENTION

The curtain coating method for the simultaneous coating of multiple layers is well known and is described in U.S. Pat. Nos. 3,508,947 and 3,632,374, which in particular teach the advantages of the method for applying photographic compositions to paper and plastic webs. Thus, these references teach the curtain coating of aqueous gelatin solutions and photographic compositions with viscosities up to and exceeding 100 mPas on photographic substrates. Aqueous gelatin is the usual vehicle for photographic compositions. A major difference between curtain coating and slide bead coating, as taught in U.S. Pat. No. 2,761,791, is that high viscosity compositions can be curtain coated while the bead method fails; consequently, curtain coating offers improved uniformity and reduced drying load for increased productivity with existing dryers. The capability to apply high viscosities arises because the coating composition impinges against the receiving surface at a high speed as a consequence of gravitational acceleration in the free-falling curtain. This impinging flow is sometimes said to provide a hydrodynamic assist for the wetting of the receiving surface.

For a manufacturing process it is desirable to coat at the highest possible speed to maximize productivity from capital equipment. To those skilled in the art of curtain coating, the primary limitations to coating speed are well known (see *Liquid Film Coating* ed. S. F. Kistler and P. M. Schweizer, Pub. Chapman Hall, 1997). Air entrainment marks the inclusion of air between the coating composition and the receiving surface leading to bubbles or non-uniformities in the coating or both. Puddling refers to the formation of a heel of coating composition at the impingement point of the curtain on the side of the approaching receiving surface. This puddle or heel can be unsteady and so produce a non-uniform coating. Flow recirculations in the heel can trap particles or bubbles and produce a streaked coating. Whether or not particles are trapped, the presence of a heel promotes air entrainment at relatively low speeds as described in the article "Hydrodynamics of Dynamic Wetting" by T. D. Blake, A. Clarke, and K. J. Ruschak, *AIChE Journal*, Vol. 40, 1994, p. 229. As taught in the article by Clarke in *The Mechanics of Thin Film Coatings*, ed. P. H. Gaskell et al, World Scientific, 1995, increasing the curtain height, increasing curtain flow rate, and reducing viscosity, separately or in combination, promotes puddling. Coating more layers simultaneously, another way to enhance productivity, promotes puddling by increasing total flow rate.

Various methods have been advanced to postpone air entrainment to higher speeds. Some of these methods take advantage of studies of dynamic wetting showing that lowering viscosity increases air-entrainment speeds. However, in curtain coating, lowering viscosity also promotes puddling, and so anticipating the net result is difficult. In addition, if viscosity is lowered by the addition of solvent, which is usually water for photographic coating compositions, the maximum coating speed for a given drying capacity is reduced.

Many practical coating compositions are non-Newtonian. A Newtonian liquid has a single viscosity value. However, liquids containing high molecular weight polymer or high concentrations of emulsified liquids or dispersed solids typically have a viscosity that decreases with increasing shear rate, the rate of deformation in flow. Such liquids are called shear thinning or pseudoplastic. Typically for such liquids, the viscosity is constant at low shear rates. Above a certain shear rate, viscosity falls as shear rate increases. Ultimately, however, increasing the shear rate leads to the leveling off of viscosity at a value that may be far below that at low shear rates. A standard representation of such behavior is the Carreau model (see for example, "Dynamics of Polymeric Liquids", R. B. Bird, R. C. Armstrong, O. Hassager, Vol. 1 second edition 1987), $$\eta = \frac{\eta_0 - \eta_\infty}{(1 + (\lambda\gamma)^2)^{\frac{1-n}{2}}} + \eta_\infty \qquad \text{Equation 1}$$

where $\eta$ is the viscosity (mPas) at steady shear rate $\gamma(s^{-1})$, $\eta_0$ is the constant viscosity (mPas) at low shear rates often referred to as the low-shear viscosity, $\eta_\infty$ is the constant viscosity (mPas) at high shear rates, $\lambda$ is a time constant (s) and n is the dimensionless power law index. Values for $\lambda$ and n are obtained by fitting viscosity measurements of the liquid to Equation 1. For a Newtonian liquid, n equals 1, and for shear-thinning liquids n is less than 1; the smaller that n is, the more rapidly viscosity falls with increasing shear rate.

To obtain high coating speeds, U.S. Pat. No. 5,391,401 to Blake et al. teaches an optimum rheological profile, by which is meant an optimum relationship between viscosity and shear rate. The optimum rheological profile for curtain coating provides a low viscosity at the shear rates expected near the dynamic wetting line, where the coating composition wets the receiving surface, and a high viscosity at the much lower shear rates expected in all other parts of the flow. A low viscosity at the wetting line promotes high speeds without air entrainment, while the higher viscosity elsewhere reduces the propensity for puddling and promotes the delivery and drying of uniform layers. However, highly shear-thinning coating compositions require coating dies custom designed for uniform distribution across the width of the coating, whereas for slightly shear thinning coating compositions, general purpose dies may be used. Gelatin, the primary binder for photographic products, is slightly shear thinning, and so highly shear-thinning coating compositions depend upon the presence of other components, such as polymeric thickening agents or concentrated colloids. Moreover, the amount of gelatin required by the formulation can limit the extent of shear thinning. It can therefore be difficult to obtain a specific rheological profile while maintaining the product-specific properties of a coating composition.

A method to increase speeds has been taught in EP 0563308 to Blake and Ruschak whereby air entrainment is postponed to higher speeds while suppressing puddling. In this method the direction of movement of the receiving surface is angled with respect to the plane of the curtain such that the curtain forms an acute angle with the approaching receiving surface, and high curtains are used for hydrodynamic assist of dynamic wetting. The geometric change reduces the propensity for puddling and thereby allows advantage to be taken of both a high impingement speed and a shear-thinning coating composition to increase coating speed. However, the speed increase by this method is limited by the achievable low level of viscosity of the coating composition at high shear rates.

In other methods, forces are applied, such as by an electrostatic or magnetic field, to postpone air entrainment to higher coating speeds. The creation of an electrostatic field at the impingement point to increase speeds in curtain coating is taught in WO 89/05477 to Hartman. However, this method can be limited by puddling when used in conjunction with high flow rate or low viscosity.

Another method to alleviate the problems of puddling and air entrainment is taught in U.S. Pat. No. 5,393,571 to Suga et al. In this method, coating compositions with high viscosity at low rates of shear, around 10 $s^{-1}$, are applied to a receiving surface of significant roughness using curtain coating. The method applies to flow rates above 4 cc/s per cm of coated width, a nominal roughness of the receiving surface exceeding 0.3 microns, a low-shear viscosity of a coating composition exceeding 90 mPas, an average viscosity for all layers exceeding 80 mPas, and coating speeds exceeding 325 m/min. There exist several standard measures, $R_a$, $R_z$, $R_{max}$, etc. (see DIN4768, ISO4287, BS1134), for specifying surface roughness relating to different phenomena. For example, $R_a$=0.3 $\mu$m and $R_z$=0.3 $\mu$m specify significantly different surfaces. Furthermore, $R_a$ and $R_z$ can give numerical values differing by an order of magnitude for the same surface. Thus the roughness values specified for the method of Suga et al. are nominal and do not unequivocally identify applicable surfaces. Many substrates for photographic products, and likely all paper substrates, ostensibly meet this nominal roughness requirement. Suga et al. teach increasing the viscosities of coating compositions for the purposes of their method by the addition of a thickening agent that interacts with the binder in the composition, i.e. gelatin, to increase the viscosity at low shear rate without substantially increasing its viscosity at high shear rate, the implication being that a high viscosity at high shear rates is disadvantageous. However, thickening agents added to photographic compositions can cause interactions with other components that adversely affect the product. Insolubility is an example of an adverse chemical interaction, and degraded hardness and sensitometric response are examples of adverse performance interactions.

In view of increasing demands for productivity, there is need for a high-speed curtain-coating method negating the limitations of puddling and air entrainment. Such a method should have latitude for accommodating a wide range of viscosity because of the practical problems of achieving high viscosity in all cases. The range of viscosity latitude should preferably extend to high viscosity obtained through reducing volatile components such as water in order to reduce drying load and so obtain higher coating speeds on the same manufacturing equipment.

SUMMARY OF THE INVENTION

It is an object of the present invention to provide a curtain-coating method capable of attaining coating speeds significantly higher than attainable by prior art. A further object is to provide a high-speed method having wide viscosity latitude including high viscosity obtained through reducing the amounts of volatile components in the coating composition.

The present invention comprises the steps of forming a composite layer of one or more layers of coating composition providing a coating composition adjacent to the receiving surface having a viscosity of 90 mPas to 220 mPas at shear rate of 10,000 $s^{-1}$, forming a free-falling curtain of the composite layer, impinging the curtain on a continuously moving receiving surface of significant roughness, such as paper substrates.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

Figure 1:
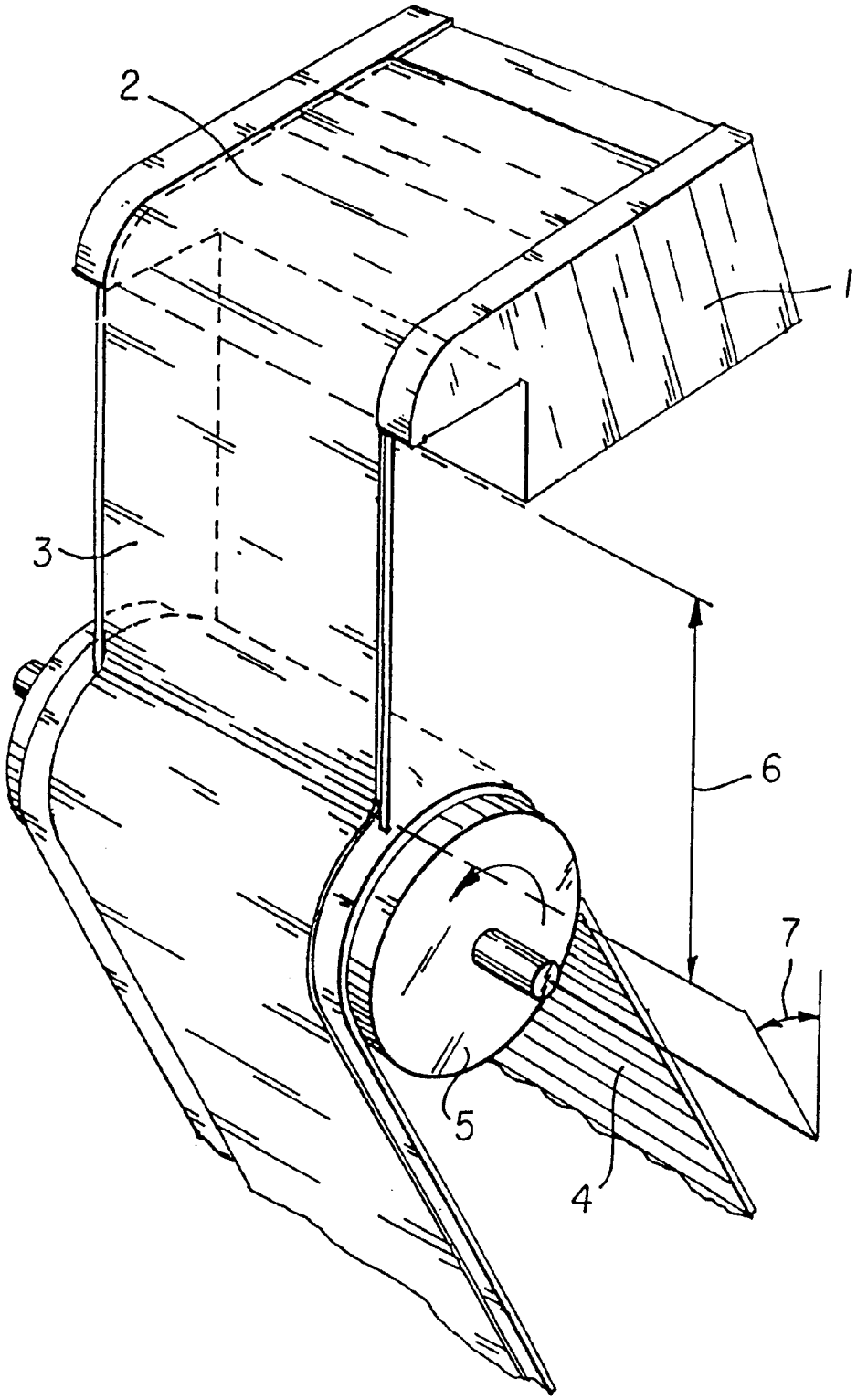
FIG. 1 is a diagram of a typical curtain coating apparatus.
Figure 2A:
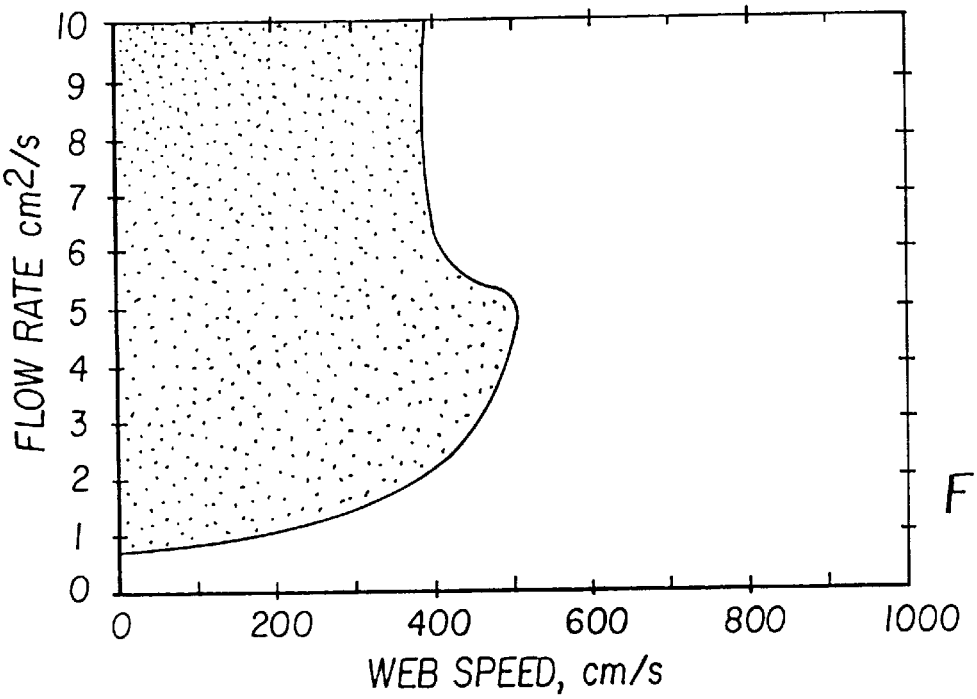
FIGS. 2*a, b, c*, and *d* are coating maps showing the effects of the viscosity of the coating composition and the roughness of the receiving surface. The receiving surface in (*a*) and (*b*) is gelatin coated polyethylene terephthalate and in (*c*) and (*d*) is photographic resin-coated paper. (*a*) $R_z$=0.7 $\mu$m, $\eta_0$=22 mPas, (*b*) $R_z$=0.7 $\mu$m, $\eta_0$=170 mPas, (*c*) $R_z$=4.4 $\mu$m, $\eta_0$=22 mPas, (*d*) $R_z$=4.4 $\mu$m, $\eta_0$=170 mPas. Curtain height=7 cm, application angle=+45°, aqueous gelatin solutions.
Figure 2B:
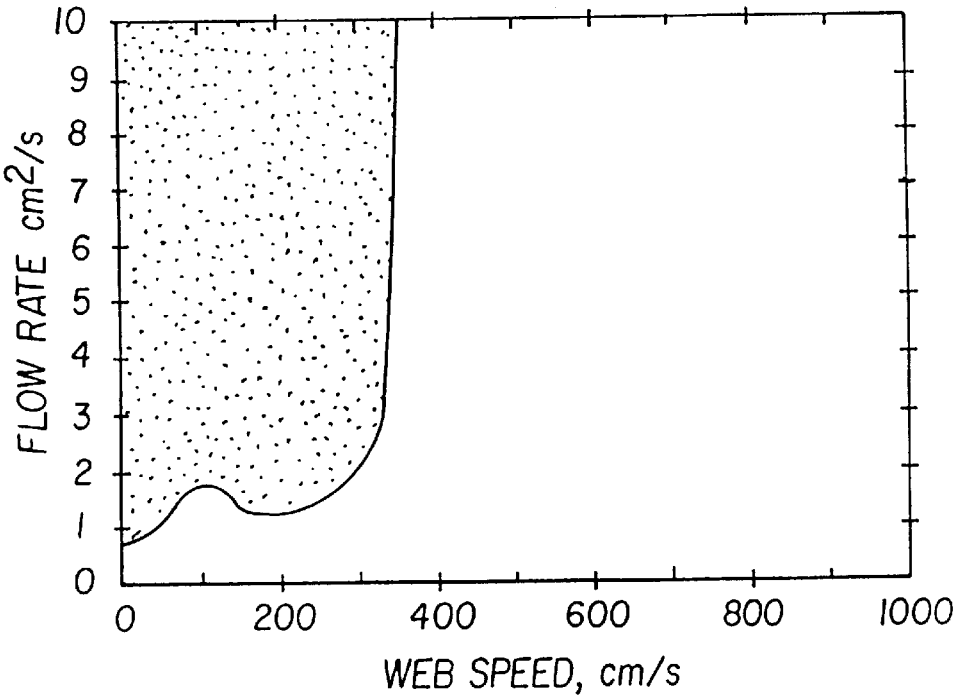
Figure 2C:
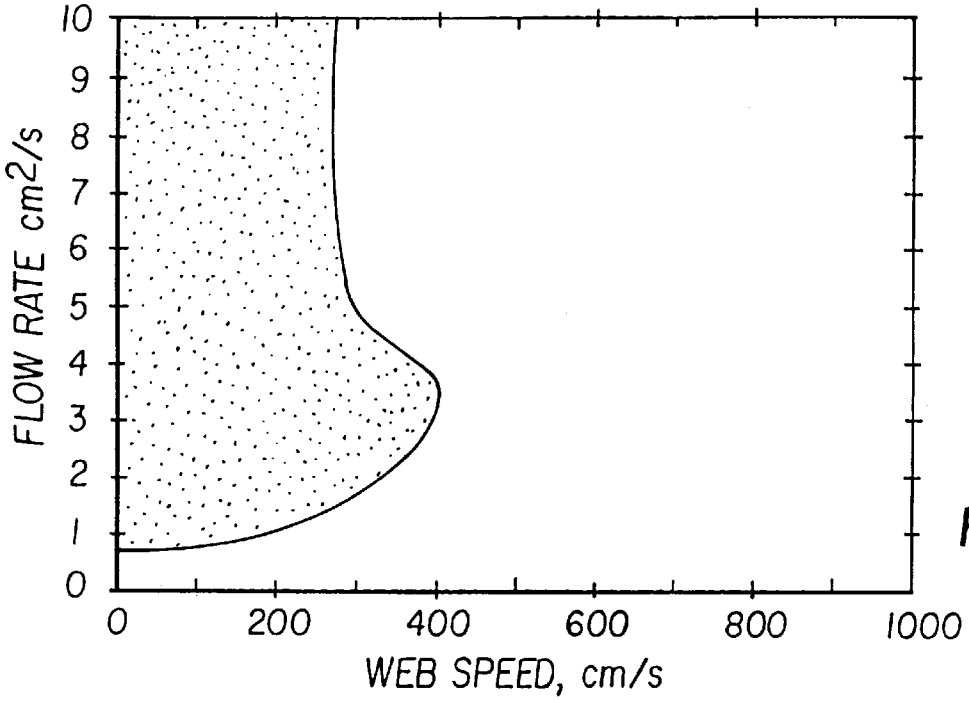
Figure 2D:
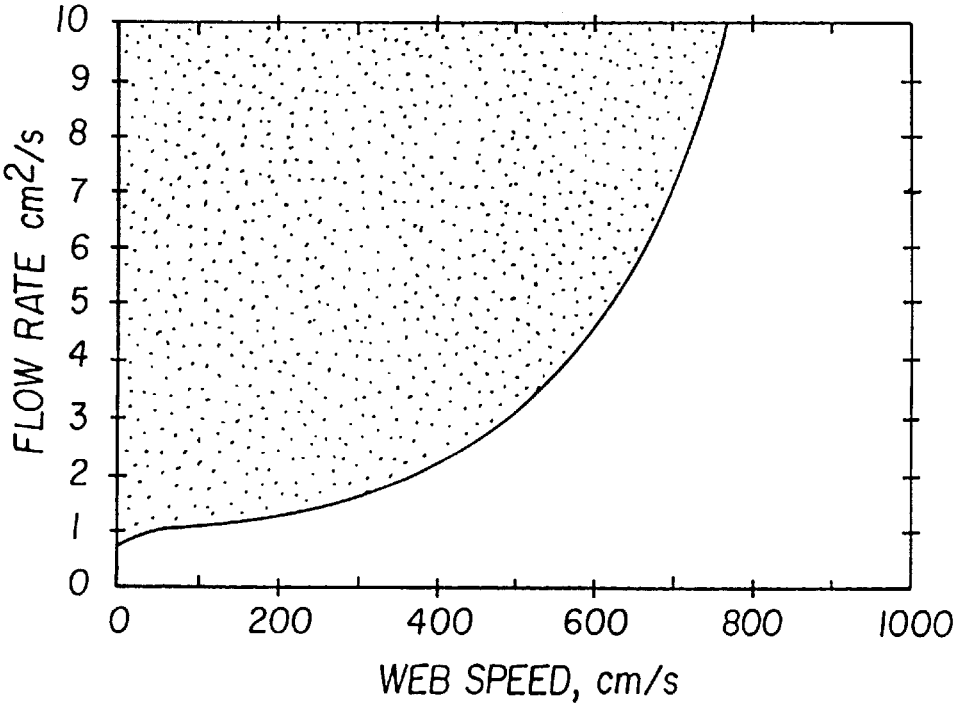

FIG. 1 shows a schematic drawing of a typical multiple-layer curtain-coating process. A coating die, 1, supplies one or more coating compositions to an inclined sliding surface, 2, such that the coating compositions form a composite layer without mixing. The composite layer then forms a free-falling, substantially vertical curtain 3 that impinges onto a continuously moving receiving surface 4. A flexible receiving surface may be supported at the point of impingement by a backing surface 5 that may be a roller. Relevant parameters include the total flow rate per unit width of curtain, Q, the speed of the receiving surface, S, the curtain height 6, (h), and the application angle 7, (θ). The application angle is the inclination of the receiving surface from horizontal at the impingement point, and positive application angles indicate a receiving surface with a downward component of velocity. For a backing surface that is a roller, the application angle is the angular location of the impingement point measured from the top of the roller in the direction of rotation. For a specified curtain height such as 10 cm to 30 cm and application angle such as 0° to 60°, a diagram may be experimentally determined defining the range of flow rates and coating speeds at which the curtain-coating of a substantially uniform composite layer can be conducted. Such a diagram is termed a coating map.

FIG. 2 shows four coating maps with shaded regions delineating substantially uniform coating. Maps (a) and (c) are for a receiving surface having a surface roughness $R_z$(DIN)=0.7$\mu$m and maps (b) and (d) are for a receiving surface having a surface roughness of $R_z$(DIN)=4.4 $\mu$m. In each case the coating composition is an aqueous solution of gelatin, the usual vehicle for photographic products, and so is slightly shear thinning. Maps (a) and (b) are for an aqueous gelatin solution having a low-shear viscosity of 22 mPas whereas maps (c) and (d) are for an aqueous gelatin solution having a low-shear viscosity of 170 mPas. On the smoother substrate, increasing the viscosity leads to lower coating speeds (compare windows (a) and (b)) in accord with the prior art taught in EP 0563308; conversely, on the rougher substrate, increasing the viscosity leads to higher coating speeds (compare windows (c) and (d)). For the lower viscosity liquid; increasing the roughness leads to lower coating speeds (compare windows (a) and (c)), whereas for the higher viscosity liquid the opposite result is obtained, increasing the roughness leads to higher coating speeds (compare maps (b) and (d)). The present invention relates to the benefit demonstrated in map (d) of FIG. 2, corresponding to a surface of significant roughness and a high viscosity coating composition.

Figure 3A:
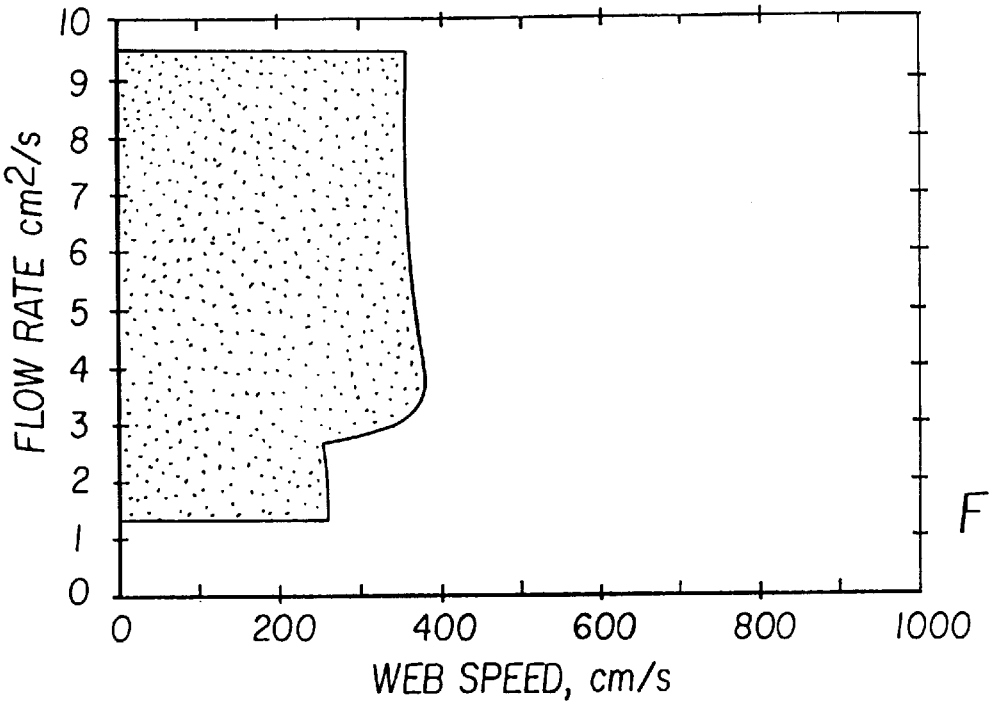
FIGS. 3*a* and *b* are plots showing the effect of high-shear viscosity. Curtain height=2 cm, application angle=0°, photographic resin coated paper surface with $R_z$=4.4 $\mu$m, low-shear viscosity of 140 mPas for both solutions. (*a*) 3% aqueous gelatin plus 0.31% w/w NaPSS, n=0.66, (*b*) 18% aqueous gelatin, n=0.94.
Figure 3B:
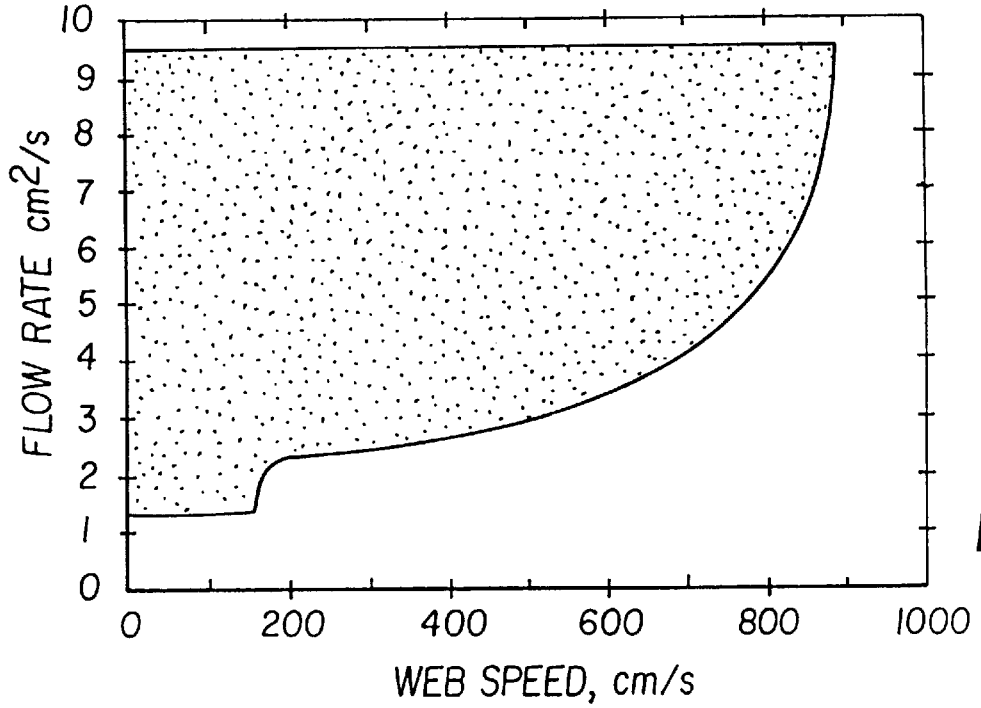
Figure 4A:
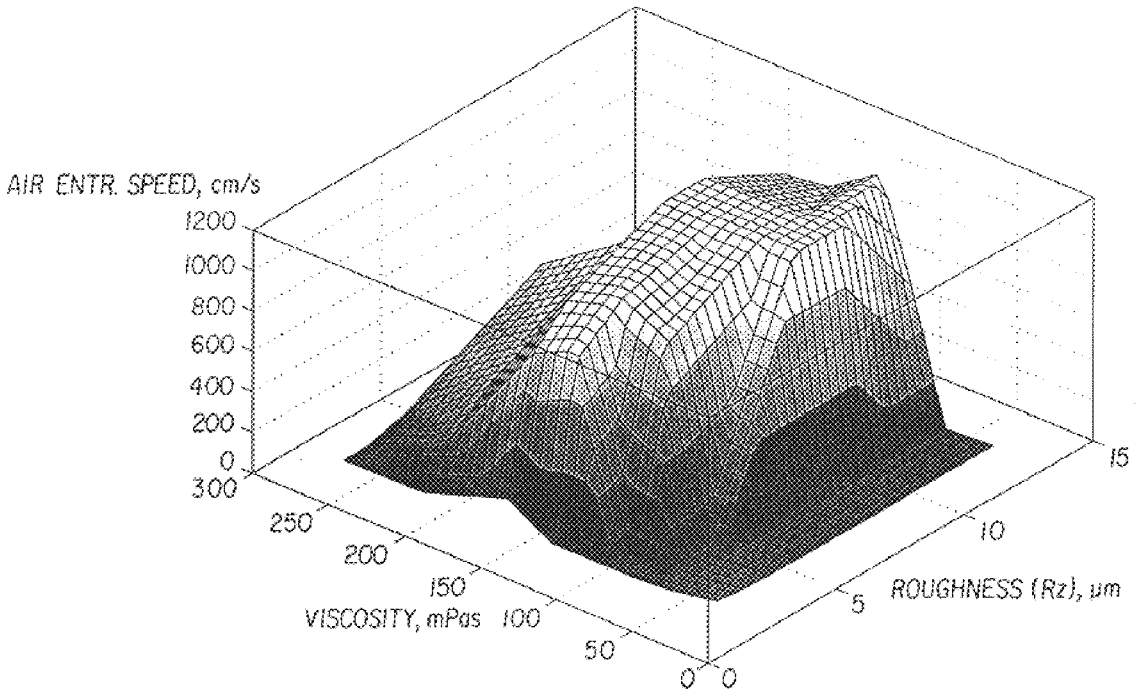
FIG. 4*a* is a surface plot showing speed for air entrainment as a function of viscosity and roughness, $R_z$, for a range of photographic resin coated paper surfaces. Curtain height=3 cm, application angle=0°, flow rate=4.2 $cm^2/s$, aqueous glycerol solutions.
Figure 4B:
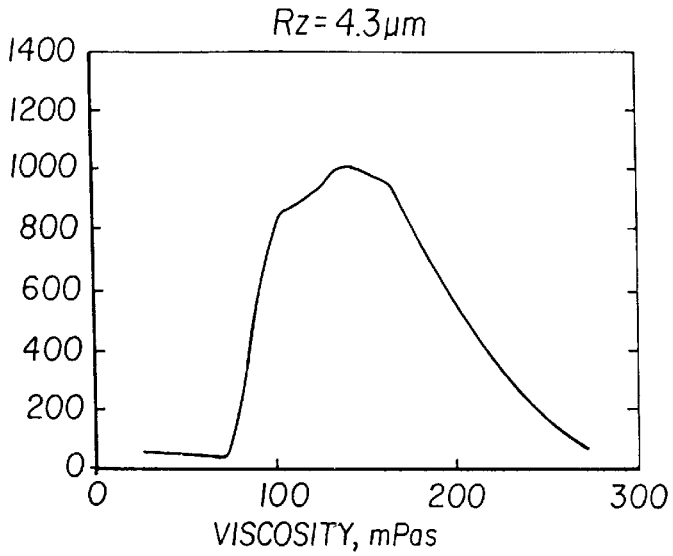
FIGS. 4*b, c* and *d* are sections of surface plot FIG. 4*a*.
Figure 4C:
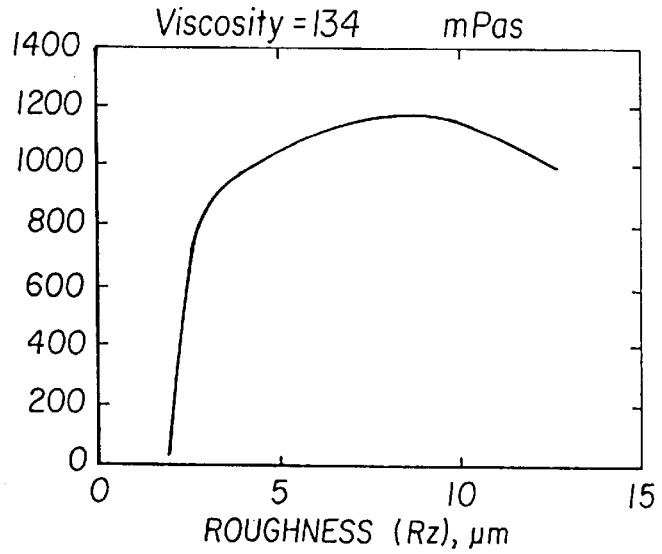
Figure 4D:
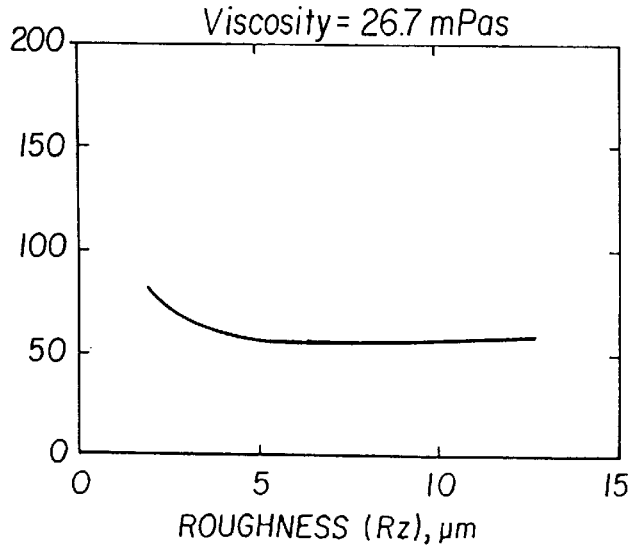

FIG. 3 shows two coating maps. Each map delineates a region of substantially uniform coating for a coating liquid of low-shear viscosity 140 mPas on a receiving surface of roughness $R_z$(DIN)=4.4 $\mu$m. Map (a) is for a 3% w/w aqueous gelatin solution containing one of many possibly viscosifying or thickening agents, 0.31% w/w sodium polystyrene-sulphonate (NaPSS-Versa TL502). Map (b) is for 18% w/w aqueous gelatin. The viscosities of these two coating compositions were measured over a range of shear rates with a Bohlin CS rheometer (Bohlin Industries), and the measurements were fitted to Equation 1. When this is done the value of the power law index, n, obtained is n=0.66 for the significantly shear-thinning solution containing NaPSS, whereas n=0.94 is obtained for the slightly shear-thinning solution of gelatin alone. Remarkably greater coating latitude is obtained for 18% w/w aqueous gelatin, which has the higher viscosity at high shear rate. Coating speed is extended at all flow rates, with the greatest extension at high flow rates. This outcome is unexpected in light of U.S. Pat. No. 5,391,401, which teaches a rheological profile having a relatively low viscosity at high shear rate, and U.S. Pat. No. 5,393,571, which teaches high low-shear viscosity obtained by a thickening agent not substantially increasing viscosity at high shear rate.

FIG. 4 shows a diagram (a) where air entrainment speed is plotted as a function of both viscosity and the roughness of the receiving surface, $R_z$(DIN). Plots (b–d) show curves derived from the surface diagram. The curtain flow rate is 4.2 $cm^2/s$, the curtain height is 3 cm, the application angle is 0°, and the coating liquids are various concentrations of aqueous glycerol, a coating composition that is Newtonian (n=1) so that viscosity is independent of shear rate. For a particular surface roughness (b), as viscosity increases the air-entrainment speed initially decreases in accordance with the teachings of U.S. Pat. No. 5,391,401, but when a critical viscosity is reached, and provided the surface roughness $R_z$ is large enough, the air-entrainment speed increases remarkably. Thereafter, as the viscosity is increased further, the air entrainment speed again decreases. Thus there is a viscosity maximizing coating speed for a specified web roughness. This eventual drop in speed with increasing viscosity is not taught in U.S. Pat. No. 5,393,571, which specifies only that average viscosity exceed 80 mPas. Alternatively, curve (c) of FIG. 4 shows that the air-entrainment speed goes through a maximum as surface roughness increases, another effect that is not taught in the prior art. For example, U.S. Pat. No. 5,393,571 specifies only that surface roughness exceed 0.3 $\mu$m. Curve (d) shows that speed decreases with increasing roughness for a viscosity below the critical value. In FIG. 4, air-entrainment speed attains its maximum value at a roughness, $R_z$, of about 8 $\mu$m and a viscosity of about 140 mPas. The nominal roughness specified in U.S. Pat. No. 5,393,571 is R>0.3 $\mu$m, but no increase in speed is found until $R_z$(DIN) exceeds 2.0 $\mu$m. These results for aqueous glycerol, for which the viscosity in the curtain-coating process is not in doubt, together with the results of FIG. 3, unequivocally and unexpectedly establish that a high viscosity at high shear rate is advantageous on a receiving surface of significant roughness.

Figure 5:
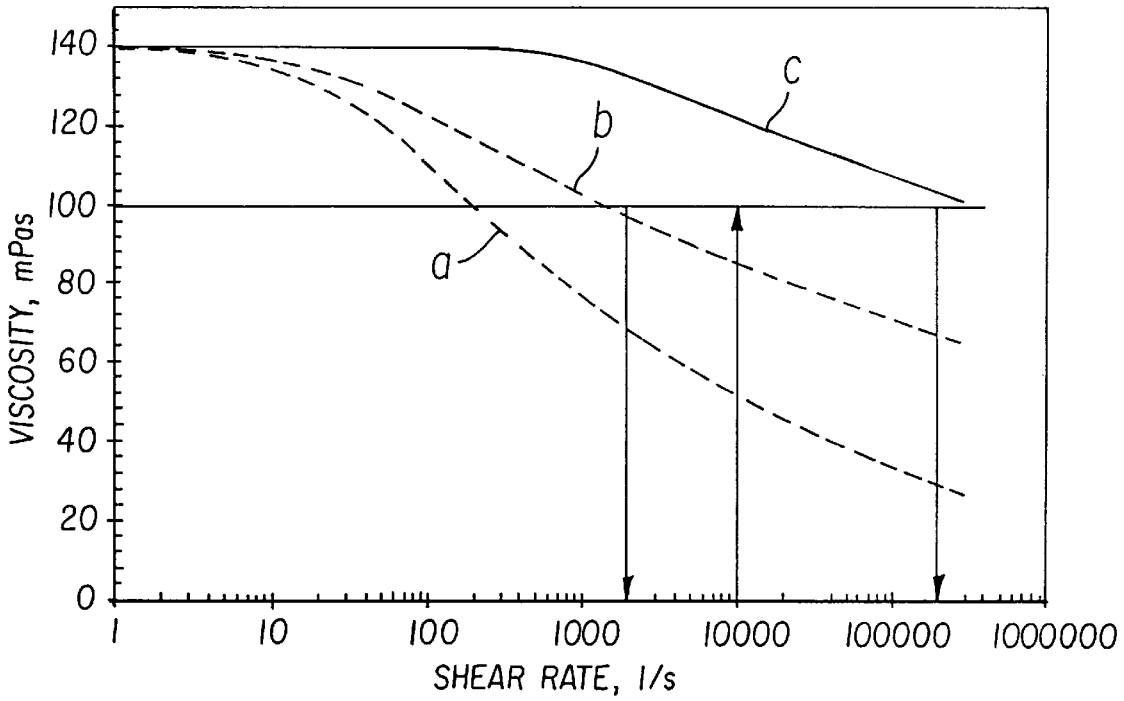
FIG. 5 is a plot of viscosity versus shear rate for three coating compositions.

The results at high viscosity cited for non-shear-thinning aqueous glycerol and slightly shear-thinning aqueous gelatin imply that coating compositions are advantageously discriminated based on their viscosity at high shear rates and the roughness $R_z$ of the receiving surface. A shear-rate for measuring high-shear viscosity can be determined by considering coating compositions having the same low-shear viscosity but different high-shear viscosities as shown in FIG. 5. For a curtain height of 3 cm, application angle of 0° and web roughness, $R_z$(DIN), of 4.4 $\mu$m, the compositions corresponding to curves (a) and (b) in FIG. 5 do not show a large increase in air-entrainment speed whereas the composition corresponding to curve (c) does. Since the data in FIG. 4 is for a Newtonian liquid, and so the viscosity at which the transition occurs is known; for the specified conditions, it is approximately 100 mPas. Hence, from FIG. 5 we may determine for each composition the shear rate at which the viscosity drops below this value and the corresponding shear rate. In this manner 10,000 $s^{-1}$ is determined as the shear rate at which the high shear viscosity is measured for the purposes of the invention.

To maximize the air-entrainment speed for the coating parameters pertaining to FIG. 4, the coating liquid forming the layer adjacent to the web surface should have either a viscosity, measured at a shear rate of 10,000 $s^{-1}$, of between approximately 90 mPas and approximately 220 mPas for surfaces with roughness, $R_z$(DIN), between approximately 2.2 $\mu$m and approximately 7.5 $\mu$m, or a viscosity, measured at a shear rate of 10,000 $s^{-1}$, of between approximately 70 mPas and approximately 270 mPas for surfaces with roughness, $R_z$(DIN), between approximately 7.5 $\mu$m and approximately 12.5 $\mu$m. More generally it is useful to define a specifying parameter $\phi_0$, linking the significant variables of curtain coating and encompassing the conditions of the invention. Specifically, $$\phi_0 = 1818\sigma^{1/3} R_z\left\{\frac{1}{0.0002}\eta U\cos(\theta)\left(1+\Omega\frac{\rho Q}{20\eta}\right)\right\} \qquad \text{Equation 2}$$

$$\Omega = \frac{25}{25+\left(\frac{\rho Q}{\eta}-8\right)^2}$$

where, $\sigma$ is the liquid surface tension (N/m) measured as close to the liquid impingement point as possible (U.S. Pat. No. 5,824,887 issued Oct. 20, 1998), $R_z$ is the surface roughness (m) (e.g. as measured using the WYKO NT2000, WYKO corporation), $\eta$ is the viscosity (Pa s) measured at a shear rate of 10,000 $s^{-1}$ (e.g. as measured using a Bohlin CS rheometer), U is the curtain terminal velocity (m/s) ($U=\sqrt{2gh}$, where g the acceleration due to gravity ($m/s^2$) and h is curtain height (m)), $\theta$ is the application angle, $\rho$ is the liquid density ($kg/m^3$) and Q is the curtain flow rate per unit width of curtain ($m^3/s$ per m of width). For the present invention, the value of $\phi_0$ should be greater than 1 and preferably greater than 1.5. The specifying parameter $\phi_0$ is effective for curtain heights greater than 7 cm. For curtain heights less than 7 cm, the specifying parameter $\phi_0$ is a good indicator, but is less discriminating. In all cases, it is advantageous to attain as high a value of $\phi_0$ as possible while keeping $R_z$ and $\eta$ within the ranges recited above.

Various receiving surfaces can be employed in the application of the present invention and include, but are not limited to, paper, plastic films, resin-coated paper and synthetic paper. Plastic substrates may be made of polyolefins such as polyethylene and polypropylene, vinyl polymers such as polyvinyl acetate, polyvinyl chloride and polystyrene, polyamides such as 6,6-nylon and 6-nylon, polyesters such as polyethylene terephthalate and polyethylene-2,6-naphthalate, polycarbonates and cellulose acetates such as cellulose monoacetate, cellulose diacetate and cellulose triacetate. Resins used to make resin-coated paper are exemplified by but not limited to polyolefins such as polyethylene. Additionally, the substrates may have subbing layers containing surfactants. The substrates may also be composite layers comprising a plurality of layers. The receiving surfaces may be embossed.

The receiving surface useful in the practice of the invention has a surface roughness, $R_z$(as defined by DIN 4768), between about 2 $\mu$m and about 20 $\mu$m. Examples of such receiving surfaces are photographic papers which have a glossy surface, matte surface, luster surface, etc. These substrates are commonly manufactured from raw paper stock onto which is laminated a polyethylene layer that may be compressed with an embossed roller to obtain a desired appearance for photographic prints. Alternatively, receiving surfaces with the specified roughness may be obtained by employing solid particles or the like dispersed and coated within the subbing or other previously coated and dried layers of a photographic substrate, or by embossing or finely abrading the aforesaid plastic film substrates, or by any other method that leads to a surface topography having the specified measured roughness.

The coating composition of the invention may have a wide range of components depending on the specific use of the final product. Examples of compositions that may be used include compositions for the manufacture of photographic products comprising light sensitive layers, subbing layers, protective layers, separating layers etc.; compositions for the manufacture of magnetic recording media; compositions for adhesive layers; color layers; conductive or semiconductive layers; anti-corrosion layers; etc.

For the method, the coating parameters are advantageously chosen to maintain the wetting line position as defined in Ruschak et al., AIChE Journal 40 2 (1994) 229 to be close to the location of curtain impingement. To this end, the application angle is advantageously chosen commensurate with the desired curtain height and flow rate. Curtain height is advantageously increased as viscosity is increased. Curtain heights between 10 cm and 35 cm and application angles between 0° and 60° are preferred. The following example illustrates the present invention.

EXAMPLE 1

A slightly shear-thinning coating composition of aqueous gelatin containing 0.1% w/w surfactant having a low-shear viscosity of 120 mPas was coated at a curtain height of 25.4 cm, an application angle of +45°, a flow rate of 5 $cm^3/s$ per cm of width and a speed of 800 cm/s to give dry samples for testing. Three samples were obtained using the following surfaces:

(i) A gelatin coated polyethylene terephthalate surface of roughness $R_z$(DIN)=0.7 $\mu$m gave a non—uniform coating with air bubbles. $\phi_0$=0.3.

(ii) A photographic resin-coated paper surface of roughness $R_z$(DIN)=4.4 $\mu$m gave a uniform coating without air bubbles. $\phi_0$=2.4.

(iii) A photographic resin-coated paper surface of roughness $R_z$(DIN)=9.7 $\mu$m gave a uniform coating without air bubbles. $\phi_0$=5.3.

It is clear that when $\phi_0$ is greater than 1, substantially uniform coatings were obtained whereas when $\phi_0$ was less then 1, unacceptably non-uniform coatings were obtained.

The invention has been described in detail with particular reference to certain preferred embodiments thereof, but it will be understood that variations and modifications can be effected within the spirit and scope of the invention.

What is claimed is:

1. A curtain coating method comprising the steps of:

a) forming a composite layer of a plurality of coating compositions;

b) forming a freely falling curtain from said composite layer and impinging said freely falling curtain against a continuously moving receiving surface, said receiving surface having a roughness, $R_z$(DIN 4768); and c) providing said coating composition forming the layer adjacent to said receiving surface with a viscosity, $\eta$, measured at a shear rate of 10,000 $s^{-1}$ such that, when combined with said roughness $R_z$, and said curtain gives a value of a specifying parameter $\phi_0$ that is greater than 1, where said specifying parameter, $\phi_0$, is defined by $$\phi_0 = 1818\sigma^{1/3} R_z\left\{\frac{1}{0.0002}\eta U\cos(\theta)\left(1+\Omega\frac{\rho Q}{20\eta}\right)\right\}$$

where, $\sigma$ is the surface tension (N/m) of the liquid layer adjacent to said receiving surface, $R_z$ is the surface roughness (m) as defined in DIN 4768, $\eta$ is the viscosity (Pa s) measured at a shear rate of 10,000 $s^{-1}$ of the composition adjacent to said receiving surface, U=v(2gh) the velocity (m/s) of said curtain just before impingement on said receiving surface, with g the acceleration due to gravity ($m/s^2$) and h the height (m) of said curtain, $\theta$ is the angle formed between said curtain and the normal to said receiving surface at the point of impingement, $\rho$ is the minimum density ($kg/m^3$) of said plurality of coating compositions, Q is the total volumetric flow rate per unit width ($m^2/s$) of said curtain, and $$\Omega = \frac{25}{25+\left(\frac{\rho Q}{\eta}-8\right)^2},$$

wherein said curtain height is at least 0.07 m, whereby high coating speeds can be attained.

2. The coating method of claim 1 wherein the calculated value of $\phi_0$ is greater than 1.5.

3. The coating method of claim 1, wherein said coating composition forming the layer adjacent to said receiving surface has a viscosity at a shear rate of 10,000 $s^{-1}$ between about 70 mPas and 220 mPas.

4. The method of claim 1, wherein the height h of said curtain is between 7 cm and 30 cm.

5. The method of claim 1, wherein said application angle $\theta$ is between 0° and 60°.

6. The method of claim 1 wherein the roughness $R_z$(DIN 4768) of the receiving surface is between about 2 $\mu$m and about 20 $\mu$m.

* * * * *